United States Patent [19]

Wilkinson

[11] Patent Number: 5,066,001

[45] Date of Patent: Nov. 19, 1991

[54] PORTABLE, FOLDABLE, ADJUSTABLE, AEROBIC EXERCISE BENCH/STEP/MAT

[76] Inventor: William T. Wilkinson, P.O. Box 378, Chesapeake City, Md. 21915

[21] Appl. No.: 577,282

[22] Filed: Sep. 4, 1990

[51] Int. Cl.[5] ..... A63B 6/00

[52] U.S. Cl. ..... 272/70; 5/465; 5/470

[58] Field of Search ..... 272/70, 101, 109; 5/417, 420, 455, 464, 465, 481

[56] References Cited

U.S. PATENT DOCUMENTS

| | | | |
|---|---|---|---|
| 836,326 | 11/1906 | Kinyon | 5/465 |
| 1,060,294 | 4/1913 | Snouffer | 5/465 |
| 2,595,111 | 4/1952 | Steward | 5/420 |
| 3,035,671 | 5/1962 | Sicherman | 272/70 |
| 3,268,922 | 8/1966 | Moxley | 5/481 |
| 3,284,819 | 11/1966 | Nissen | 272/109 |
| 3,498,605 | 3/1970 | Buttner | 5/465 |
| 3,628,790 | 12/1971 | Gordon | 272/109 X |
| 4,350,721 | 9/1982 | Nagase | 272/109 |
| 4,459,714 | 7/1984 | Lin | 5/465 |
| 4,689,844 | 9/1987 | Alivizatos | 5/455 |
| 4,697,290 | 10/1987 | Alklind et al. | 5/455 X |

*Primary Examiner*—Richard J. Apley
*Assistant Examiner*—L. Thomas
*Attorney, Agent, or Firm*—Connolly & Hutz

[57] ABSTRACT

A portable, foldable, adjustable, aerobic exercise bench/step/mat comprises a plurality of individual panels secured by flexible hinges to each other so that the panels can be arranged in various orientations with respect to each other. For example, if all of the panels are placed side by side the result is a mat which could be used for aerobic exercise. When, however, one or more panels are folded on top of each other then the overall height is increased so that the stacked panels can then be used as a bench or step in an aerobic exercise such as the stepping up and stepping down from the stacked panels.

7 Claims, 9 Drawing Sheets

PORTABLE, FOLDABLE, ADJUSTABLE, AEROBIC EXERCISE BENCH/STEP/MAT

Background of Invention

In my U.S. Pat. Nos., 4,340,218 and later patents, I disclose various devices which may be used for aerobic exercise in the form of single step climbing wherein a step would be used by the user stepping up and stepping down during an exercise program. A key feature of these devices is the ability to adjust the height of the step so as to conform to the specific exercise needs of the users. It would be desirable if an alternative form of aerobic exercise bench or step could be provided which would have the advantages of being portable, foldable and adjustable. It would also be desirable if such a device could be provided which could also function as an exercise mat.

Summary of Invention

An object of this invention is to provide a device which fulfills the above needs.

A further object of this invention is to provide a method of using such a device.

In accordance with this invention the portable, foldable, adjustable, aerobic exercise bench/step/mat comprises a plurality of panels which are hingedly secured together so that the panels can be placed in various orientations with respect to each other. For example, when the panels are placed side by side a mat results which could be used for exercise. Alternatively, the panels may be folded atop each other and the number of panels that are folded would control the overall height of the stacked panels. The resultant stacked panels could function as a bench or step in an aerobic exercise program of the type described in my patents.

The panels may be secured together in a permanent manner or detachably secured. Such detachably securement may be by ring and eyelet assemblies or may be by a zipper connection. A further manner of securing the panels is to provide a cover or pouch having a series of pockets corresponding to the number of panels so that the individual panels could be inserted into the pockets.

In a preferred practice of this invention a handle is provided to facilitate carrying the panels. The handle is secured to straps which encircle the panels when the panels are stacked atop each other.

In a still further practice of this invention the panels may be foldable both transversely and longitudinally to add to the height adjustability.

The Drawings

Detailed Description

Figure 1:
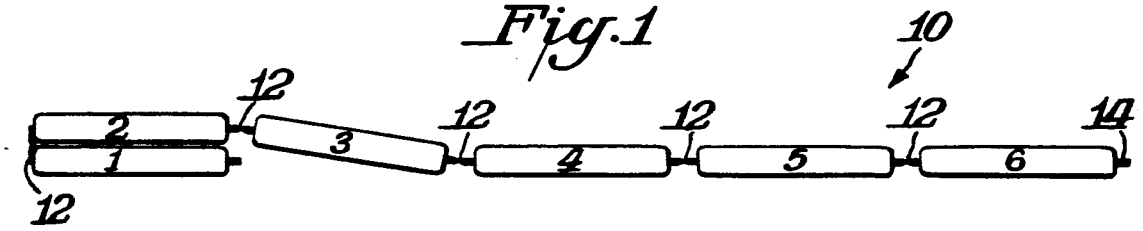
FIG. 1 is a side elevation view of a portable, foldable, adjustable, aerobic exercise bench/step/mat in accordance with this invention during one position of use.

The present invention, in general, comprises the utilization of a plurality of panels which are secured to each other by flexible hinges so that the panels may alternately be placed side by side or in various stacked arrangements. In its broadest aspect, the plurality of panels includes at least two panels, and preferably six panels which are rectangularly shaped and joined in a side by side relationship so that any number from two to six of the panels may be stacked atop each other, thus varying the overall height of the stacked arrangement. For example, in an aerobic exercise program which involves the stepping up and stepping down from a bench or step, it is desirable to have the height of the step at least four inches and to have the ability to increase the height to at least 12 inches for a more advanced exercise program. In its broad practice the invention may be used wherein the height is adjustable to the maximum of 20 inches, although 12 or 14 inches is the more common maximum height required by most users. Accordingly, if for example, each panel is made two inches thick then the height of the step can be increased by increments of two inches which would begin with four inches when two panels are stacked atop each other and would be increased by two inch increments to 12 inches when there is an arrangement of six panels or to 14 inches when there is an arrangement of seven panels.

FIGS. 1–4 illustrate the practice of this invention wherein the device 10 includes a series of six panels each of which is numbered 1–6 respectively. The adjacent panels are connected to each other by any suitable hinge 12. The hinge 12 would be formed by joining longitudinal flaps or flanges extending down the side of each panel. The flexibility and length of the hinge flaps or flanges 12 between adjacent panels permits the panels to be selectively stacked atop each other. Similarly, flaps or flanges 14 would be provided at the outer faces of end panels 1 and 6 and exposed to facilitate the connection of a further panel so that the string of panels could be increased.

Figure 2:
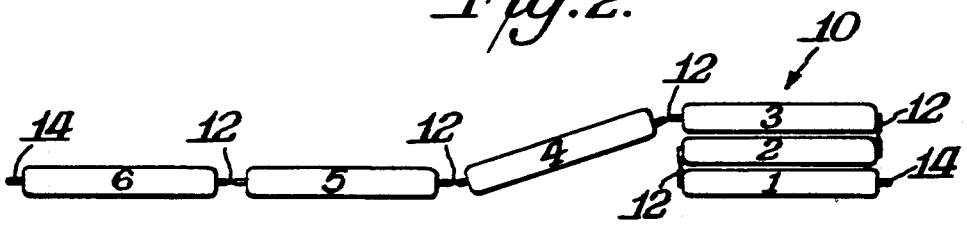
FIGS. 2–4 are side elevation view similar to FIG. 1 showing different forms of use.
Figure 3:
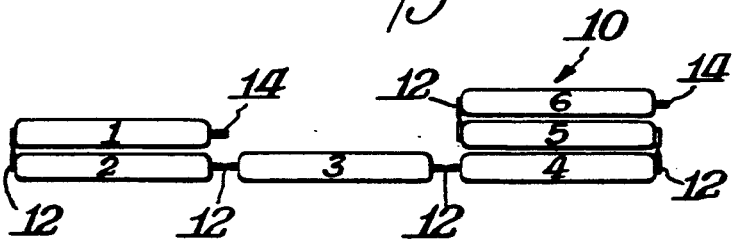

FIG. 1 illustrates the device 10 wherein panel 1 is folded under panel 2. Accordingly, the stacked relationship of panels 1 and 2 would comprise a step 4 inches high in contrast to the remaining panels 3–6 providing a mat 2 inches high. FIG. 2 illustrates panels 1, 2 and 3 to be stacked atop each other to create a step 6 inches high. FIG. 3 illustrates a variation wherein panels 1 and 2 are stacked atop each other at one end of device 10 while panels 4, 5 and 6 are stacked atop each other at the other end of the device 10. In this embodiment, an exercise program could be used by having the user step from the floor to the stack of panels 1 and 2 which is 4 inches high, then down onto intermediate panel 3, then up onto the stack of panels 4, 5 and 6 which is 6 inches high and finally down onto the floor. This could be repeated with the user stepping up and down from the floor on each side of the two stacks of panels and also stepping on the intermediate panel and on the stacks of panels or by the simply stepping up and down from the various stacks of mats or from a single mat.

Figure 4:
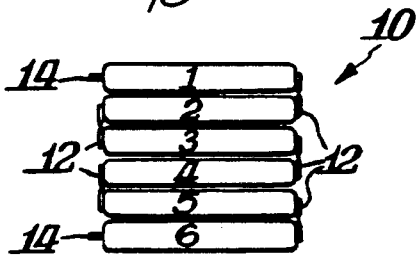

FIG. 4 illustrates the use of device 10 wherein all 6 panels are stacked atop each other to form a step or bench which is 12 inches high.

Figure 5:
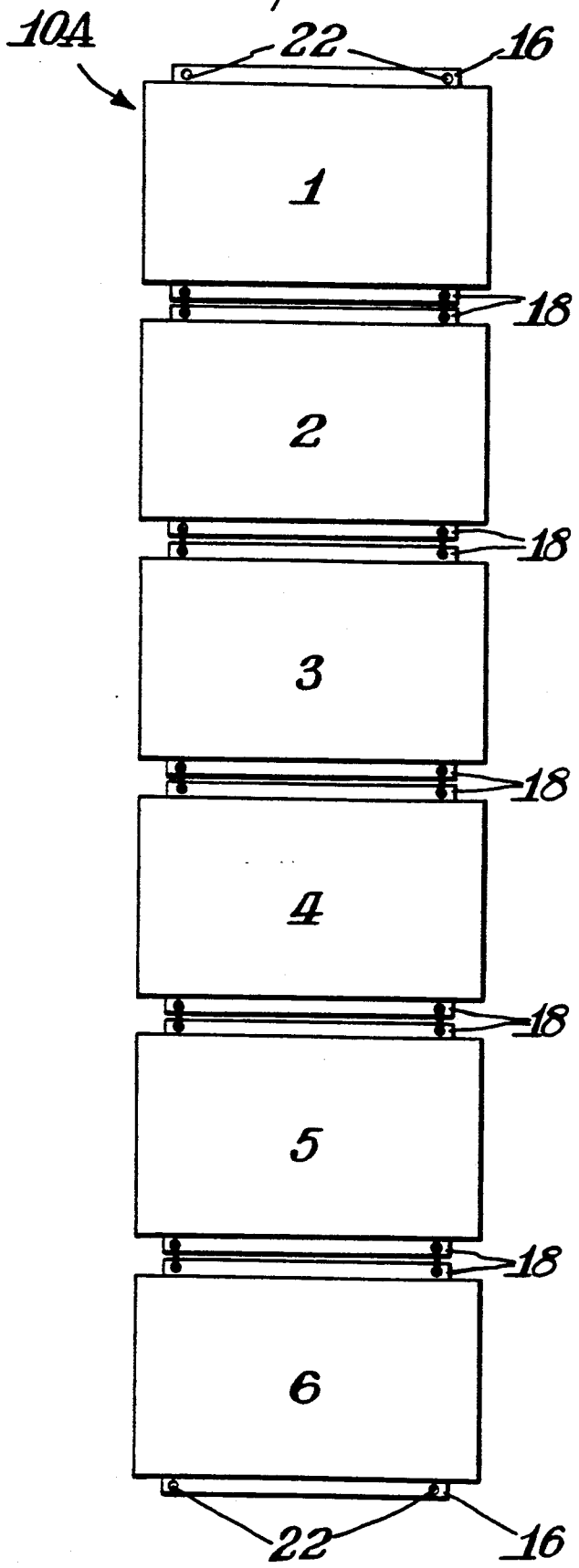
FIG. 5 is a top plan view of an alternative form of device in accordance with this invention.
Figure 6:
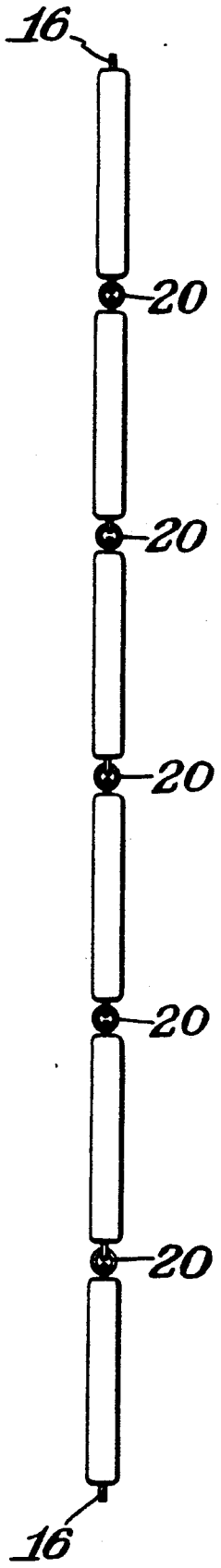
FIG. 6 is a side elevation view of the device shown in FIG. 5.
Figure 7:
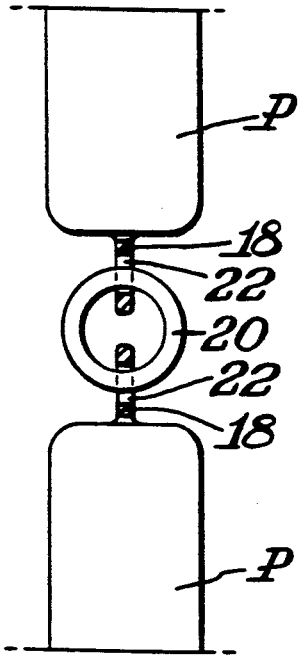
FIGS. 7–8 are plan views showing various detachable couplers usable with this invention.

FIGS. 5–6 show a variation of this invention wherein the device 10A has the panels detachably secured together. In this respect, the invention may be practiced with a permanent securement of these panels, such as illustrated in FIGS. 1–4 or a detachable securement. The permanent securement could be by sewing or otherwise fastening flaps 12 together. As shown in FIGS. 5–6 the detachable securement is effected by having flaps or flanges 18, 18 of adjacent panels secured together by means of rings 20. FIG. 7 shows the details of this securement in an enlarged view which indicates each flange 18 to have an eyelet 22 into which the ring 20 would be inserted. Adjacent panels are indicated by the letter P. As shown in FIG. 5 the flanges 16 on the end panels 1 and 6 would also be provided with the eyelets 22 so that additional panels could be attached if desired.

Figure 8:
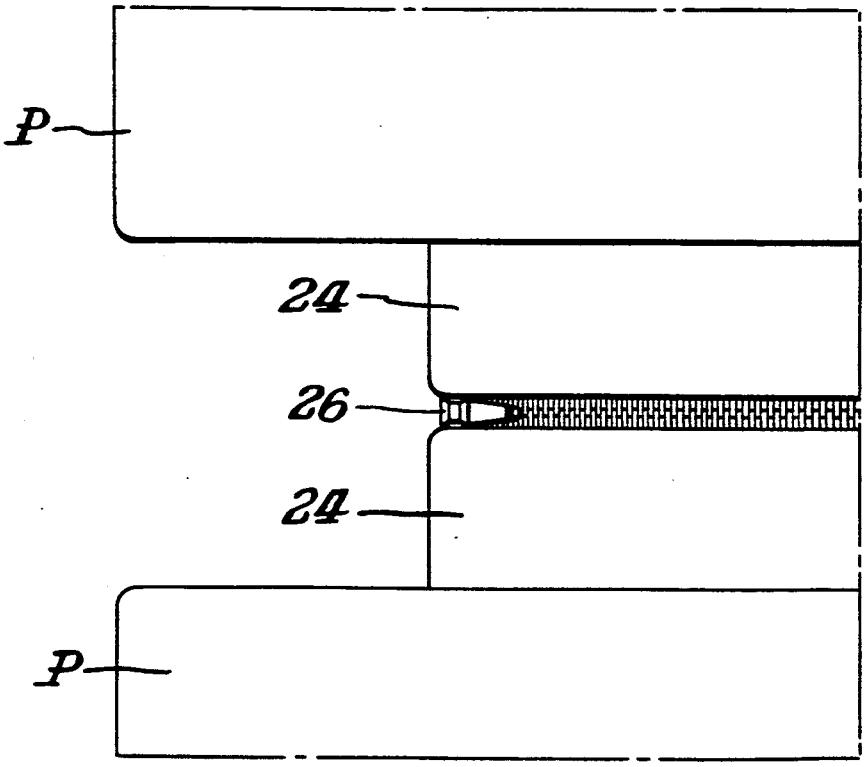

FIG. 8 shows an alternative manner of detachably securing adjacent panels P. In this variation, flanges 24 are secured together by a zipper 26. It is to be understood that the invention may be practiced with any suitable means of detachable securement. What is necessary is that the means of attachment should have sufficient flexibility and should be suitably dimensioned to permit one panel to be folded over or stacked upon its adjacent panel.

Figure 9:
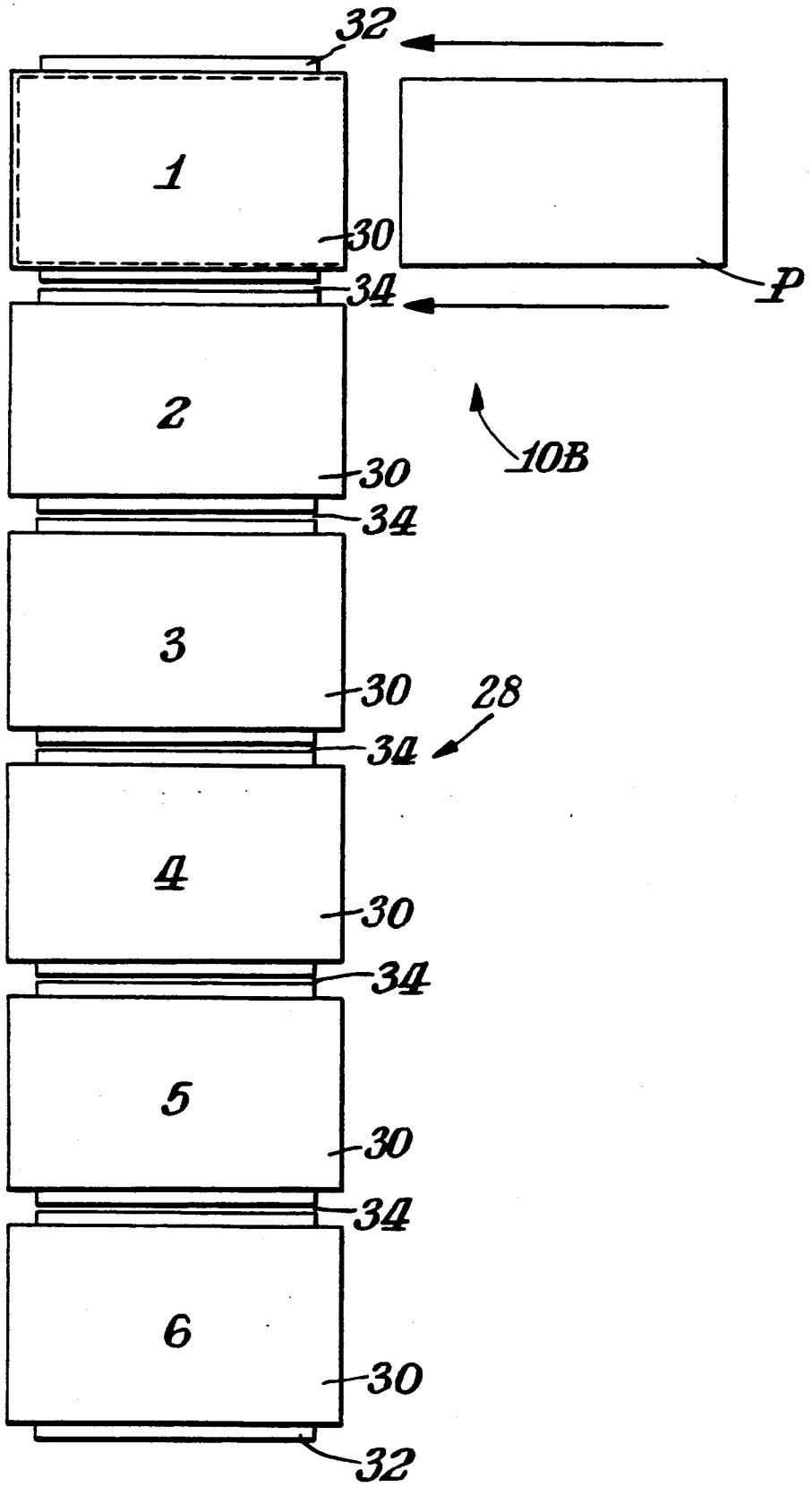
FIG. 9 is a top plan view showing an alternative view of this invention.

FIG. 9 illustrates a further practice of this invention wherein the device 10B includes a mat cover 28 having a series of pockets 30 open at one end for receiving a foam panel P. When the panels are inserted into the pockets a series of covered panels 1–6 results. If desired the open end of each pocket could then be closed by a zipper or other suitable means to prevent unintentional removal of panels. Each covered panel would be hingedly connected to its adjacent panel by flexible hinge 34 as previously described with the end panels having a connecting piece or flange 32 capable of having a further pocket section secured thereto. An advantage of the cover is that it is more readily cleanable since it could be made of a washable material which could be cleaned in a home washing machine. A further advantage of using a fabric cover is that the hinge could be formed by sewing the adjacent flanges or flaps together.

Figure 10:
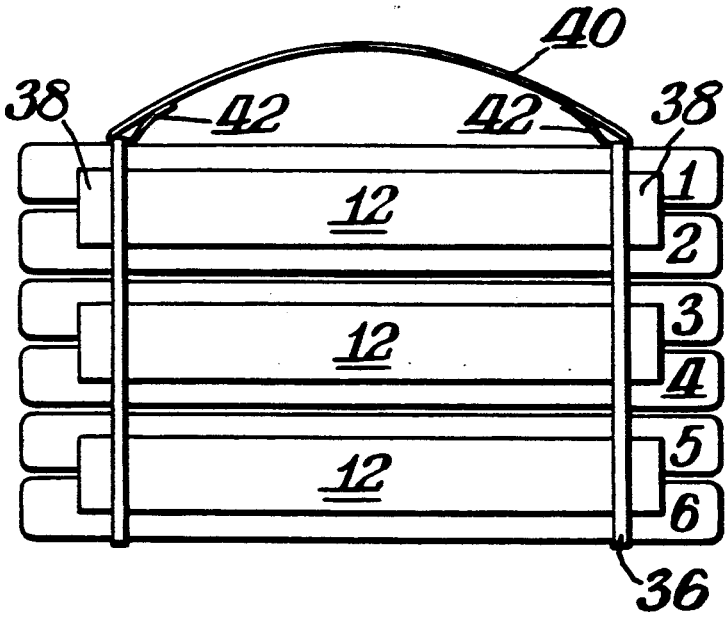
FIG. 10 is a side elevation view showing the embodiment of the invention when usable with a carrying handle.

FIG. 10 illustrates the aspect of the invention whereby the device is rendered easily portable. As shown therein a carrying arrangement 36 is provided in the form of a pair of straps 38 which would be secured around the stacked panels 1–6 at each end thereof. In the preferred practice of this invention straps 38 are made of a hook and loop fastening material so that they can be suitably mounted in a convenient manner. A carrying handle, or strap 40 is provided at the upper end of the stack arrangement by inserting the straps 38 through loops 42 at each end of carrying handle 40.

The portability aspect of the invention may also be practiced with a single strap disposed along the center of the stacked panels and the carrying handle 40 would be connected transversely of the panels to permit its portability.

If desired when the invention is practiced by having all of the panels stacked together in a single stack, as shown in FIG. 4, a strap or straps 38 may be fastened around the stack to assure maintaining the panels in a stacked condition. In this practice, handle 40 would not be attached to straps 38.

Figure 11:
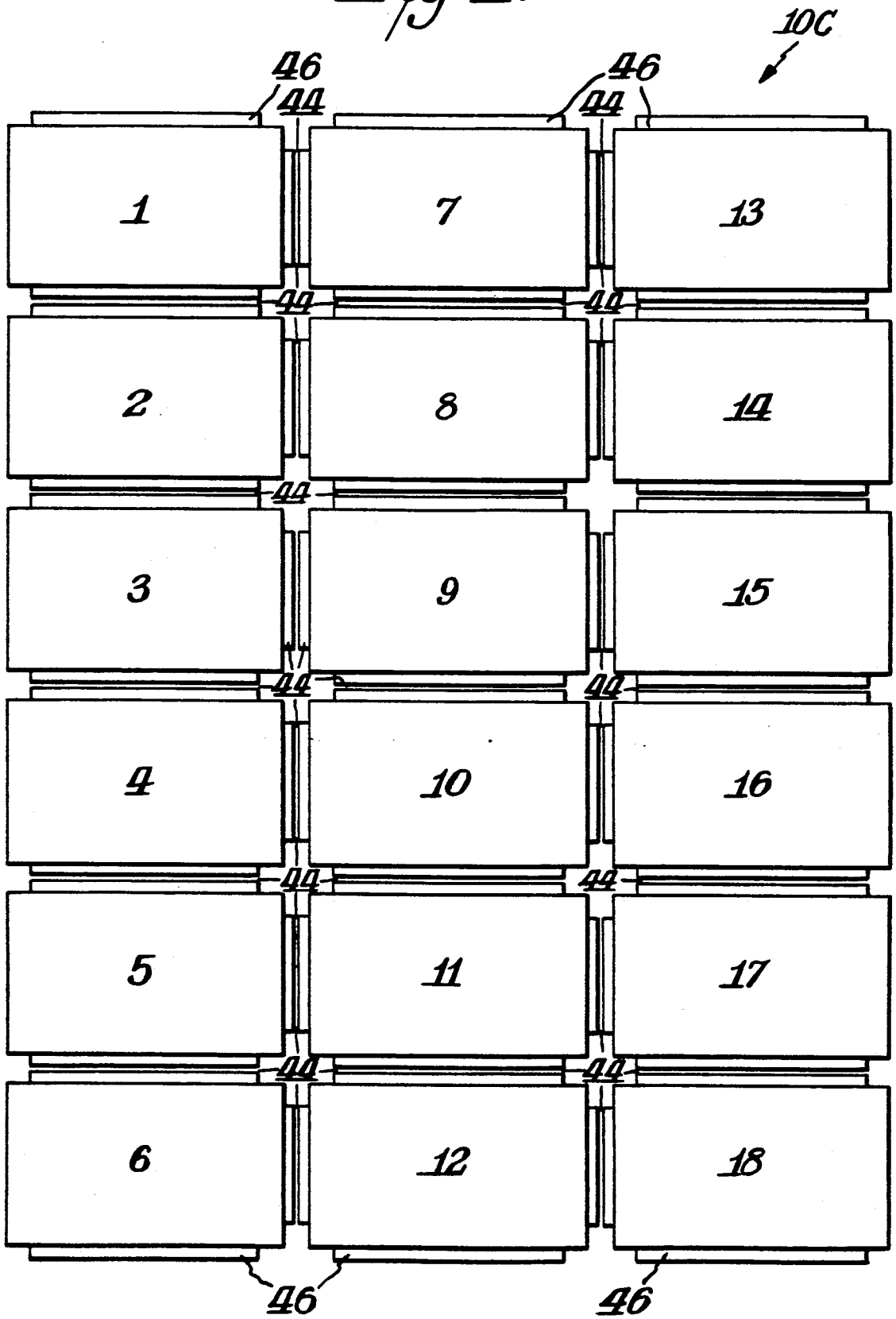
FIG. 11 is a top plan view of yet a further embodiment of this invention.

FIG. 11 illustrates yet another embodiment of this invention wherein the device 10C is made of a series of panels arranged in columns and rows. In the illustrated embodiments 18 panels which are numbered 1–18 are provided, with each panel having a flexible hinge connection 44 to join adjacent panels together. For example, panel 1 would be joined along one side to panel 2 and along an adjacent side to panel 7. The endmost panels, 1, 6, 7, 12, 13 and 18 would also be provided with flaps or flanges 46 to permit additional panels to be attached. The arrangement of FIG. 11 provides added versatility in its height adjustability in that the stacking may be both in a longitudinal and transverse direction.

Any suitable materials and dimensions may be used in the practice of this invention. In its preferred practice each panel is 2 inches thick and 5 inches long with a width of 14 inches. Accordingly, the overall dimensions of a 6 panel structure would be about 30 inches by 14 inches by 2 inches. As previously noted, the invention permits additional panels to be added so that the overall length of the mat could be increased or decreased which in turn would affect the height adjustment ability when the panels are stacked atop each other. Accordingly, the invention may be used in the normal exercise program wherein a range of height from 4 to 12 inches or 14 inches is desired. For more strenuous programs requiring a height for example of 20 inches, the invention could also be used by adding additional panels.

The panels are made of a suitable foam material, such as high density polyurethane or high density polystyrine. Such foam is not as soft as conventionally used in gymnastics mats. Additionally the general size (i.e. at least two inches thick and 14×30 wide and long) of each panel differs from conventional mats. If desired, the invention may be practiced by having one of the panels, preferably an end panel of greater thickness than the other panels so that height adjustability could be affected by providing, for example, an end panel 4 inches thick without requiring two panels to be stacked atop each other to achieve that height.

The hinge mechanism may take any suitable form, such as a permanent or detachable connection between adjacent panels. Ideally, the flanges or flaps which form the hinge connection are made of a flexible material to facilitate the bending of the hinge that is required when there is stacking. The flange material may also be stretchable to assure that a panel can be stacked atop its adjacent panel.

Figure 12:
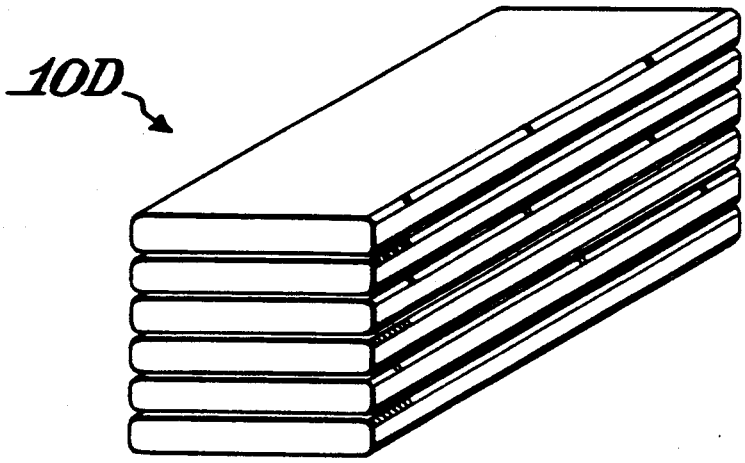
FIG. 12 is a perspective view of a modified form of this invention in one condition of use.
Figure 13:
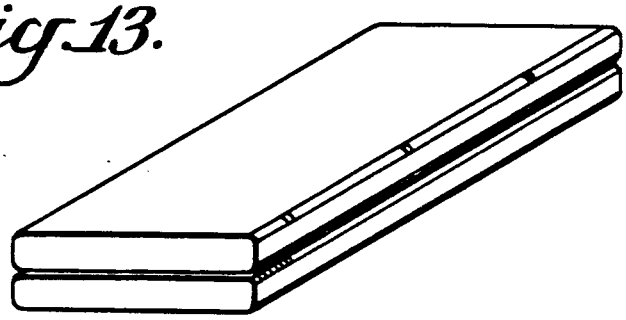
FIGS. 13–14 are perspective views of other conditions of use of the form of the invention shown in FIG. 12.
Figure 14:
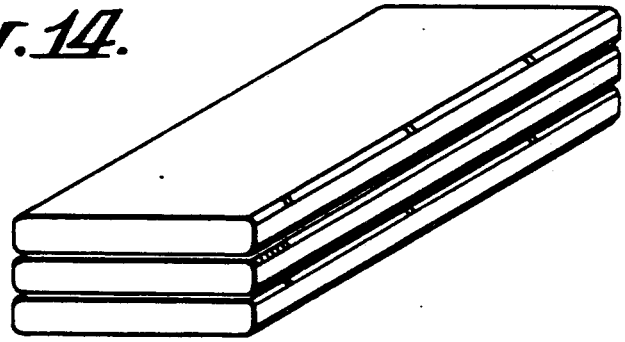

The previously described embodiments involve having some form of physical attachment of one pad to another such as by a hinge mechanism which directly connects the pads or which connects pockets in a pouch or cover. The invention, however, may also be practiced where the pads are completely detachable and are stacked atop each other. FIGS. 12–14, for example, illustrate a device 10D wherein any suitable number of pads such as panels 1–6 are provided and are stacked atop each other to provide the desired height in the aerobic exercise. FIG. 12, for example, shows all six panels stacked atop each other which would provide a height of 12 inches where each panel is two inches thick. FIG. 13 illustrates a height of four inches by stacking panels 1 and 2 atop each other. FIG. 14 illustrates a height of 6 inches when three panels are stacked atop each other.

Figure 15:
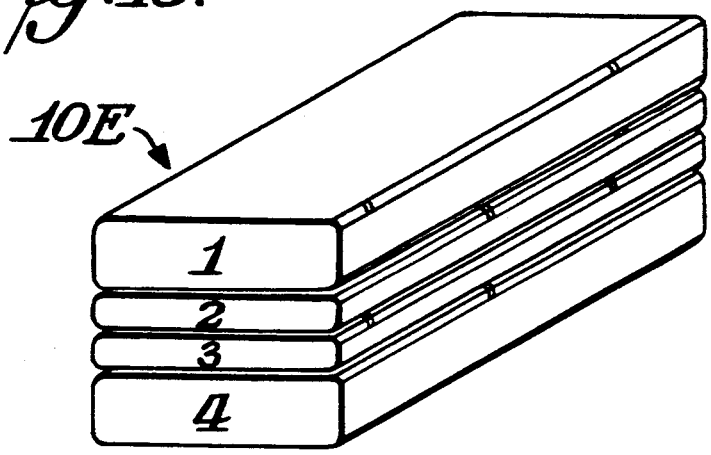
FIG. 15 is a perspective view of yet another embodiment of this invention in one condition of use.
Figure 16:
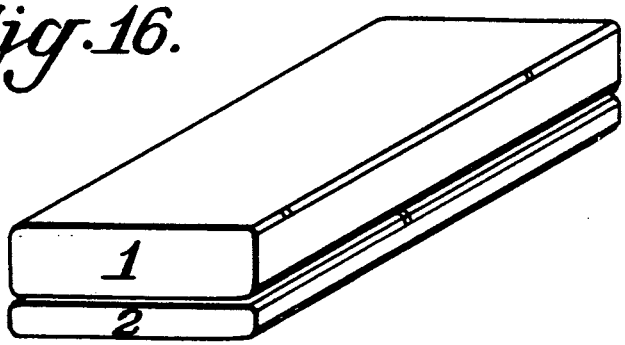
FIGS. 16–17 are perspective views of the embodiment of the invention shown in FIG. 15 in different forms of use.
Figure 17:
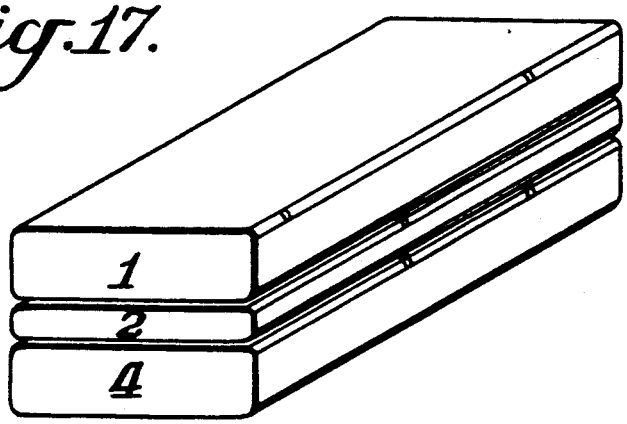

As previously indicated, it is not necessary that all of the panels be of the same thickness. FIGS. 15–17 illustrate a variation of the invention wherein the device 10E includes a stack of panels 1–4 wherein panels 1 and 4 are thicker than panels 2 and 3. For example, panels 2 and 3 might be 2 inches and panels 1 and 4 would be 4 inches. Accordingly, it is possible by various combinations of stacking arrangements to provide height adjustability between 2 inches to 12 inches. This could be achieved, for example, by using only panel 2 or 3 for a two inch height. Panel 1 or 4, when used alone would provide a 4 inch height. Panels 1 and 2 as shown in FIG. 16 would provide a 6 inch height. Panels 1 and 4 would provide an 8 inch height. Panels 1, 2 and 4, as shown in FIG. 17 would provide a 10 inch height, and all of the panels as shown in FIG. 15 would provide a 12 inch height. Additional heights could be achieved by adding other panels.

In a variation of the embodiment of FIGS. 16–17 the set of 4 panels would include 3 panels 4 inches thick and 1 panel 2 inches thick. This set of four panels would provide a range of height from 2 inches to 14 inches.

In use, because of the weight and consistency of the panels and their foam material, as well as the size of the panels there is no tendency for the stacked panels to slip with respect to each other. Accordingly, a sturdy step or bench results when a plurality of the panels are stacked atop each other. If desired, however, the invention could be practiced by using tie-down cords similar to the straps 38 to assure that the stacked panels remain stacked in a unit. Accordingly, the practice of the invention which uses completely detached panels has the advantage that such tie-down cords or straps could be used for all combinations of stack panels whereas the tie-down straps could be used on the hinged panels only for the combination when all of the panels are stacked atop each other.

Figure 18:
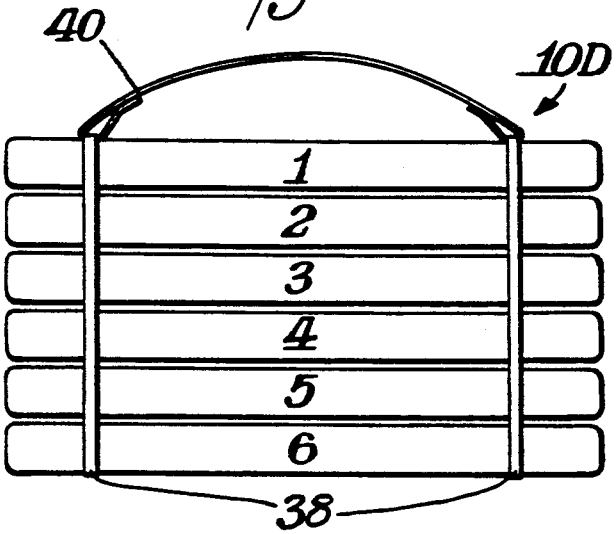
FIG. 18 is a side elevation view of the embodiment of FIGS. 12–14 in its portability condition.
Figure 19:
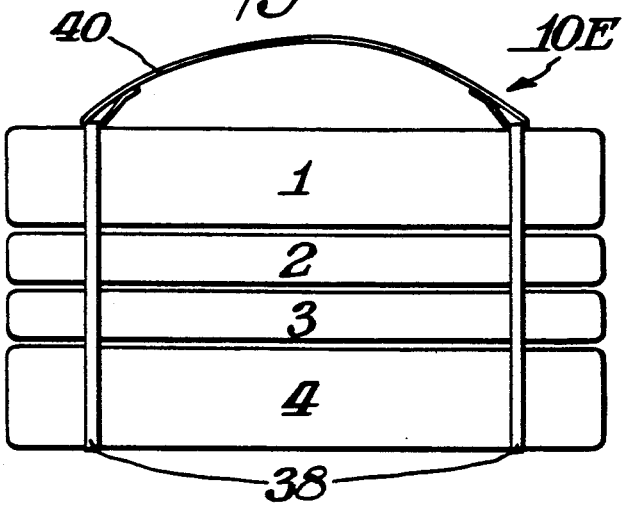
FIG. 19 is a side elevation view of the embodiment of FIGS. 15–17 in its portability position.

FIG. 18 illustrates the portability of the feature when using the device 10D. In this respect, the stacked panels would be held together by straps 38 and could be easily carried by carrying strap 40 as previously described. Similarly, FIG. 19 illustrates straps 38 to be disposed around device 10E which would be carried by strap 40.

Figure 20:
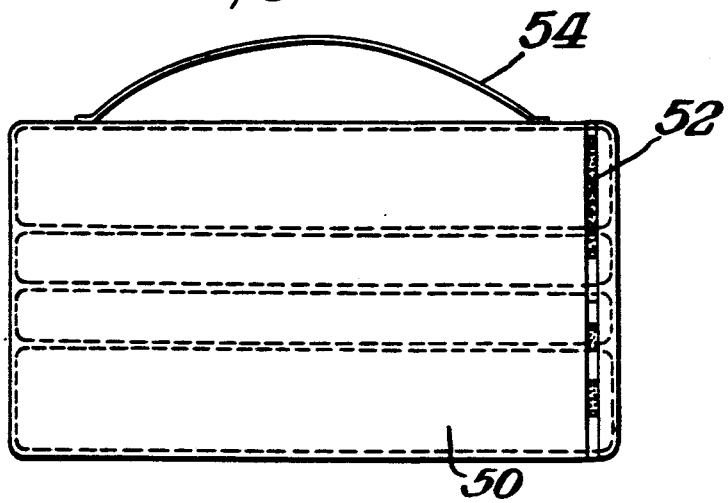
FIG. 20 is a side elevation view of the embodiment of FIGS. 15–17 in a modified portability condition.

FIG. 20 shows a variation of the invention wherein the portability is effected by inserting the stacked panels in a cover 50 which is provided with a zipper 52 to provide access to the interior of the cover. Cover 50 has its own handle 54 which is preferably permanently attached to cover 50 although a detachable handle may also be used. Cover 50 would be made of any suitable lightweight but sturdy material capable of having all of the panels from device 10D or 10E inserted therein and then the cover would be closed by zipper 52 so that it could be carried by handle 54.

The invention thus provides a convenient manner of utilizing panels whether attached by hinges or completely detached from each other to achieve the desired height adjustability necessary for an effective aerobic program of the type involving the repetitive stepping up and down.

What is claimed is:

1. A method of performing an aerobic exercise program with the use of a mat in the form of at least three side by side panels hinged together along their sides to permit the panels to be selectively stacked upon each other to create a step including the step of stacking at least one of the panels on its adjacent panel to create a stack, repeatedly stepping up and down to and from the stacked panels, creating an integral apron with the remaining panel at a height lower than the stacked panels when less than all of the panels are stacked upon each other, varying the height of the step by varying the number of panels which are stacked upon each other, and stepping up and down from the resulting different height steps.

2. The method of claim 1 including the further step of stacking all of the panels upon each other to obtain a step of maximum height.

3. The method of claim 1 wherein each panel is about two inches thick to provide a stacked panel height of at least four inches when two panels are stacked upon each other.

4. The method of claim 1 wherein the panels are hinged together by being inserted into pockets of a cover with adjacent pockets being hinged together.

5. The method of claim 1 including repeatedly stepping to and from the stacked panels and remaining panel.

6. The method of claim 1 wherein the mat includes at least six panels, including the steps of forming a first stack at least two panels high, forming a second stack at least three panels high, disposing at least one panel between the first and second stacks to create three side by side steps, and stepping up and down to and from the steps.

7. The method of claim 6 including forming the three side by side steps of heights which differ from each other.

* * * * *